US009523224B2

(12) United States Patent
Daniels

(10) Patent No.: US 9,523,224 B2
(45) Date of Patent: Dec. 20, 2016

(54) REINFORCED DEADBOLT LOCK DEVICE AND METHOD OF USE

(71) Applicant: Ron R. Daniels, Missouri City, TX (US)

(72) Inventor: Ron R. Daniels, Missouri City, TX (US)

( * ) Notice: Subject to any disclaimer, the term of this patent is extended or adjusted under 35 U.S.C. 154(b) by 133 days.

(21) Appl. No.: 13/775,880

(22) Filed: Feb. 25, 2013

(65) Prior Publication Data

US 2013/0221687 A1 Aug. 29, 2013

Related U.S. Application Data

(60) Provisional application No. 61/603,708, filed on Feb. 27, 2012.

(51) Int. Cl.

| | |
|---|---|
| ***E05B 13/10*** | (2006.01) |
| ***E05C 1/10*** | (2006.01) |
| ***E05B 17/00*** | (2006.01) |
| ***E05B 9/00*** | (2006.01) |
| ***E05B 13/00*** | (2006.01) |
| ***E05B 15/02*** | (2006.01) |
| *E05B 63/00* | (2006.01) |

(52) U.S. Cl.

CPC ..... *E05C 1/10* (2013.01); *E05B 9/002* (2013.01); *E05B 13/002* (2013.01); *E05B 15/02* (2013.01); *E05B 17/0004* (2013.01); *E05B 63/0017* (2013.01); *Y10T 29/49826* (2015.01); *Y10T 292/1028* (2015.04)

(58) Field of Classification Search

CPC ..... E05B 13/002; E05B 15/02; E05B 17/0004
USPC ..... 292/1, 137, 169.14, 169.17, 138, 145,292/146, 251, 348, 350, 356, 357, DIG. 53,292/DIG. 54, DIG. 64
See application file for complete search history.

(56) References Cited

U.S. PATENT DOCUMENTS

| | | | | |
|---|---|---|---|---|
| 242,597 | A * | 6/1881 | Gamus | 49/110 |
| 999,127 | A * | 7/1911 | Slivenick | 292/169.17 |
| 1,379,048 | A * | 5/1921 | Scholl | 70/416 |
| 1,956,388 | A * | 4/1934 | Kalina | 70/416 |
| 5,040,393 | A * | 8/1991 | Rossebo | 70/370 |
| 5,421,074 | A * | 6/1995 | Moore | 29/401.1 |
| 5,901,590 | A * | 5/1999 | Lai | 70/416 |
| 6,164,099 | A * | 12/2000 | Sh | 70/134 |
| 2008/0236221 | A1* | 10/2008 | Chen et al. | 70/266 |

* cited by examiner

*Primary Examiner* — Kristina Fulton
*Assistant Examiner* — Thomas Neubauer
(74) *Attorney, Agent, or Firm* — Ewing & Jones PLLC; Ira Domnitz

(57) ABSTRACT

An apparatus for reinforcing a deadbolt lock comprising a pin, a door brace with an orifice for a deadbolt, a base plate with an orifice for engaging said pin with a base plate further being attached to the door brace, a turn knob attached and in rotational communication with a base plate. The turn knob further comprising an orifice for said pin and a deadbolt which can extend through the door brace. When the turn knob is rotated the pin can engage the door brace or base plate and prevent movement of the deadbolt through the door brace.

11 Claims, 3 Drawing Sheets

REINFORCED DEADBOLT LOCK DEVICE AND METHOD OF USE

CROSS-REFERENCE TO RELATED APPLICATIONS

This application claims priority to U.S. provisional patent application 61/603,708, filed Feb. 27, 2012, which is incorporated by reference herein in its entirety.

STATEMENT REGARDING FEDERALLY SPONSORED RESEARCH

Not applicable

BACKGROUND

The present invention generally relates to a reinforced security deadbolt system for exterior and interior doors with interior lockout button, or push pin, to prevent usage of keys, lock bumping, or lock picking when the push pin, or lockout button is engaged.

SUMMARY

In various embodiments, the present invention describes a reinforced deadbolt with a lockout button system or push pin, designed to provide increased reinforced door strength. In various embodiments of the present invention the inventive device is installed in a door providing additional improved security while inside a room by providing a lock out system allowing the deadbolt to be secured by pushing a novel and unique lockout button, or push pin, which secures the deadbolt disallowing the use of the designated key from the outside of a door. In several embodiments of the present invention the novel invention will prevent the attempts to bump or pick a lock from the outside as well. In several embodiments of the present invention the inventive device utilizes a pin system that prevents a key from being rotated in a deadbolt lock, thereby preventing the deadbolt throwbolt from being retracted. In other embodiments of the present invention, the pin will engage the deadbolt throwbolt directly through an orifice in the deadbolt throwbolt thereby preventing retraction of the throwbolt.

In various embodiments, the present invention describes a reinforced security apparatus where the lockout button is installed in a door brace which wraps around the door edge and extends back along the door surface around the hole bored in the door for the lock assembly. In one embodiment of the present invention the strengthened area in the door edge is made when the deadbolt is installed to help prevent door kick-ins. The deadbolt can comprise a single or double keyed lock cylinder. In one embodiment of the present invention the door brace for the lock has a double thickness specially designed striker plate with recessed mounting holes designed to allow the mounting screws to be installed at an angle, preferably around thirty degrees to the building framework as well as the door frame.

In one embodiment of the present invention the invention is an apparatus for reinforcing a deadbolt lock comprising: a pin; a door brace with an orifice for engaging a deadbolt with a throwbolt; a base plate with an orifice for engaging said pin with said base plate further comprising being attached to the door brace; a turn knob attached and in rotational communication with said base plate with said turn knob further comprising an orifice for said pin; wherein the turn knob can be rotated allowing the pin to engage the base plate and prevent movement of the deadbolt throwbolt through the door brace. In one embodiment of the present invention it is envisioned that the pin may go through the door brace itself and an orifice in the throwbolt of the deadbolt thereby preventing the deadbolt throwbolt from being retracted. In such an embodiment the turn knob would extend past the perimeter of the face plate.

BRIEF DESCRIPTION OF THE DRAWINGS

For a more complete understanding of the present disclosure, and the advantages thereof, reference is now made to the following descriptions to be taken in conjunction with the accompanying drawings describing specific embodiments of the disclosure, wherein.

DETAILED DESCRIPTION

Figure 1A:
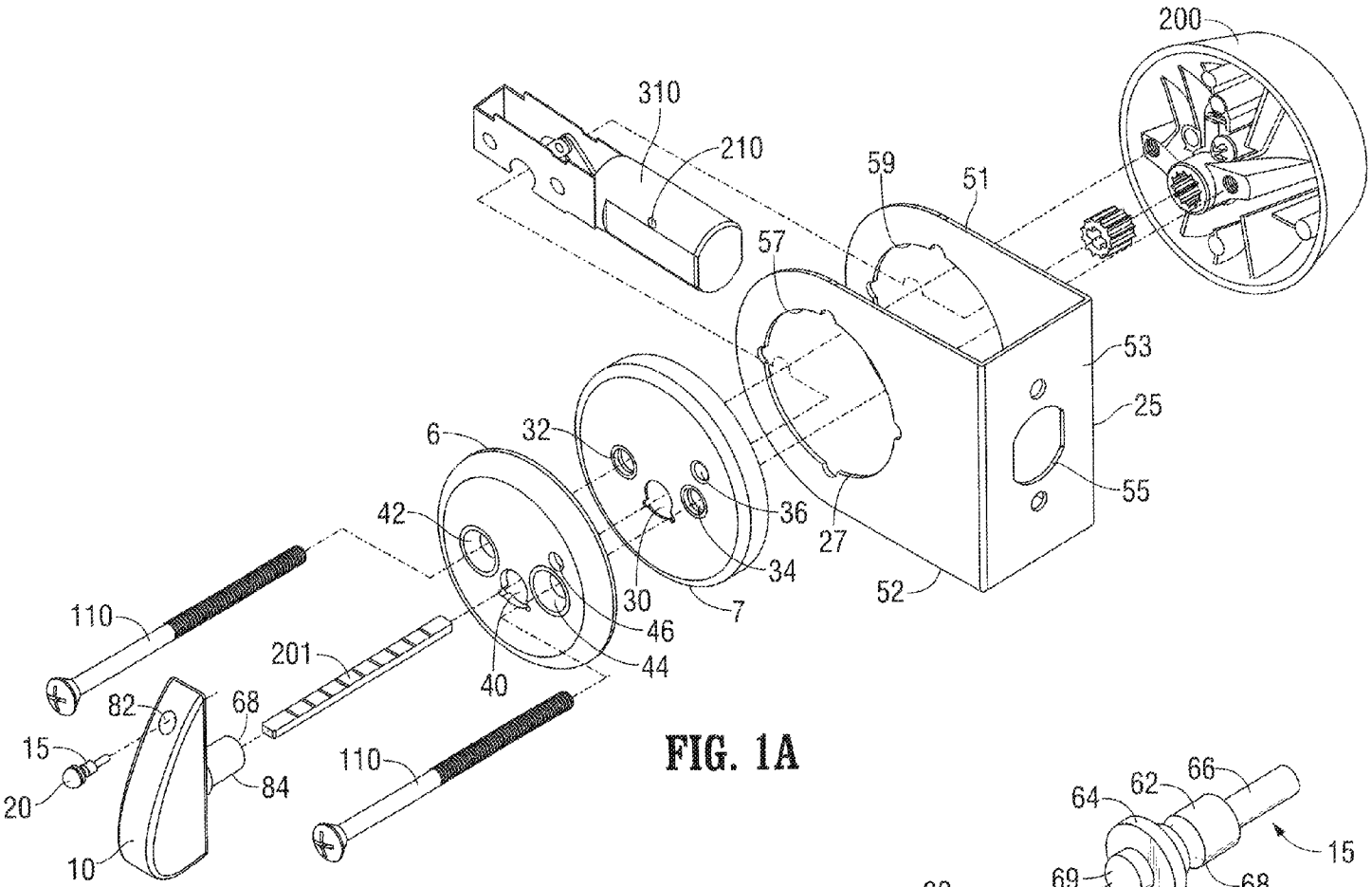
FIG. 1A illustrates one embodiment of the present device in exploded form.

In the following description, certain details are set forth such as specific quantities, sizes, etc. so as to provide a thorough understanding of the present embodiments disclosed herein. However, it will be evident to those of ordinary skill in the art that the present disclosure may be practiced without such specific details. In many cases, details concerning such considerations and the like have been omitted inasmuch as such details are not necessary to obtain a complete understanding of the present disclosure and are within the skills of persons of ordinary skill in the relevant art.

Referring to the drawings in general, it will be understood that the illustrations are for the purpose of describing particular embodiments of the disclosure and are not intended to be limiting thereto. Drawings are not necessarily to scale.

While most of the terms used herein will be recognizable to those of ordinary skill in the art, it should be understood, however, that when not explicitly defined, terms should be interpreted as adopting a meaning presently accepted by those of ordinary skill in the art. In cases where the construction of a term would render it meaningless or essentially meaningless, the definition should be taken from Webster's Dictionary, 11th Edition, 2008. Definitions and/or interpretations should not be incorporated from other patent applications, patents, or publications, related or not, unless specifically stated in this specification or if the incorporation is necessary for maintaining validity. "Throwbolt" or "throw bolt" as defined herein is to include at least any bar made of wood, metal or other materials that slides into a socket and is used to fasten doors and gates.

In general, the apparatus, systems and methods of the present disclosure are distinguished from and advantageous over other deadbolt locks, and enhancements, that are conventional in the art, because the systems and methods of the present disclosure use a new and novel locking system that utilizes a lock out system that prevents actuating the deadbolt lock even through use of the correct deadbolt lock key.

FIG. 1A illustrates, one embodiment of the exploded view of the present invention. As illustrated door brace 25 of the present invention is preferably designed to have orifice 27 which is machined to fit over the standard door side for a deadbolt lock 200 with a throwbolt 310. In this embodiment of the invention door brace 25 is made of cast iron, bronze, steel, or other suitable materials. Door brace 25 is preferably designed with three faces, 51, 52, and 53. Faces 51 and 52 are designed to be on the flat facing surface of the door 100. Face 53 is designed to be placed over the deadbolt recess 102 of the door so that in use the deadbolt throwbolt 310 can slide through orifice 55. Face 52 is preferably designed with an orifice 57 substantially sized to allow for the internal mechanisms of the deadbolt 200 mechanism to be accessible. Face 51 is preferably designed with an orifice 59 substantially sized to allow for the external key mechanisms of the deadbolt 200 mechanism to be accessible. It is envisioned that door brace 25 can be constructed with additional orifices which can be ornamental or allow for additional deadbolt lock out features.

It should be understood that in numerous embodiments of the present invention the base plate unit 7 and the covered plate 6 can be formed as a single piece, or as multiple pieces. The base plate 7 is preferably made of cast iron, bronze or other suitable materials. Base 7 is preferably designed to fit on and engage the face 52 of door brace 25. Specifically, base 7 is greater than the diameter of orifice 27 on door brace 25. Base plate 7 is preferably designed to have four orifices on its surface. Orifice 30 is substantially in the center of the base plate 7. Orifices 32 and 34 are located to each side of orifice 30. Orifices 32 and 34 are designed to have screws 110 pass threw them which will allow the base plate 7 to attach to any standard deadbolt lock 200 already being utilized in the door. Also illustrated is orifice 36 on the face of the base plate 7. Orifice 36 is designed to allow for push pin 15 to pass through it in use. The push pin 15 will then impeded the retraction of a deadbolt 200 after the deadbolt throwbolt 310 has been extended into a door 100. Specifically, the push pin 15 will prevent the rotation of a key in the deadbolt lock, thereby preventing rotation of the deadbolt shaft 201 and retraction of the actual throwbolt 310. Orifice 30 is designed to accept turn knob 10 so that it can interact with the deadbolt 200 turning mechanism, specifically the deadbolt shaft 201. In one embodiment of the present invention, the base plate 7 is designed with rounded edges. In one embodiment of the present invention is it envisioned that the present invention can be implemented onto preexisting deadbolts that are utilized presently in standard doors. Hence, in those embodiments deadbolt locks would not be included with the inventive units, as the inventive units would be applied to preexisting deadbolts.

As shown in FIG. 1A, cover plate 6 is preferably made of cast iron, bronze or other suitable materials. Cover plate 6 is preferably designed to fit on and engage the top abase plate 7. Specifically, cover plated is greater than the diameter of base plate 7. Cover plate 6 is preferably designed to have four orifices on its surface. Orifice 40 is substantially in the center of the cover plate 6. Orifices 42 and 44 are located to each side of orifice 40. Orifices 42 and 44 are designed to have screws 110 pass threw them which will allow the cover plate 6 to attach to any standard deadbolt lock already being utilized in the door. The screws 110 are preferably of those in standard use in the industry. Also illustrated is orifice 46 on the face of the cover plate 6. Orifice 46 is designed to allow for push pin 15 to pass through it in when the inventive device is in operation. The push pin 15 will then impeded the retraction of a throwbolt 310 after the throwbolt 310 has been extended into a door. Orifice 40 is designed to accept turn knob 10 so that it can interact with the deadbolt turning mechanism. In one embodiment of the present invention, the cover plate 6 is designed with rounded edges.

Figure 1B:
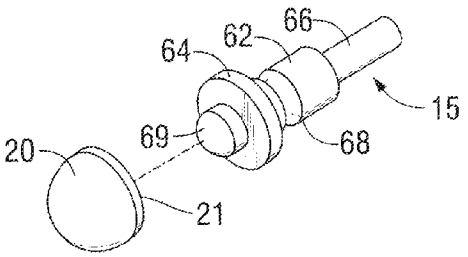
FIG. 1B illustrates one embodiment of the present device push pin and button.

FIG. 1B also illustrates one embodiment of the push pin 15 of the present invention. In this embodiment of the present invention, push pin 15 is preferably designed to have an elongated body 62 with a knob at one end 64. It is envisioned though that multiple geometric designs of the push pin 15 may be implemented by one of ordinary skill in the art. In this embodiment of the invention push pin 15 is made of cast iron, bronze, steel, or other suitable materials. Elongated body 62 is preferably designed to have an area distal to the end 64 that is of a smaller diameter in width than the general elongated body 62 called engaging area 66. Engaging area 66 is preferably designed insert into orifice 36 and 46 during the inventions locking operation, thereby preventing the movement, of the deadbolt. Push pin 15 is also preferably designed to have a turn knob interface 68 that is substantially wider than the engaging area 66. When assembled the turn knob interface 68 will be located in orifice 82 of the turn knob 10.

FIG. 1B illustrates one embodiment of the push button 20 of the present invention. In this embodiment of the present invention, push button 20 is preferably designed to have a dome shape with a hollow 21. In this embodiment of the invention push button 20 is made of cast iron, bronze, steel, or other suitable materials. It is envisioned that in various embodiments of the present invention, the push pin 15 maybe comprised as a single unit, without a push button 20, or that the push button 20 is designed in several possible geometric shapes and designs. The hollow 21 is preferably designed to attach to the knob 69 on the end 64.

FIG. 1A illustrates one embodiment of the turn knob 10 of the present invention. In this embodiment of the present invention, turn knob 10 is preferably designed to have an elongated crescent shape with an orifice 82 and a stem 84. It is envisioned that in several embodiments of the present invention the turn knob 10 can have several different shapes, lengths and geometric configurations. It is also envisioned that in some embodiments of the present invention the turn knob 10 can extend in radius further than the base plate 7, thereby allowing the push pin 15 to engage other orifices on the door brace 25. In some embodiments of the invention push turn knob 10 is made of cast iron, bronze, steel, or other suitable materials. When assembled the turn knob interface 68 will be located in orifice 82 of the turn knob 10. The stem 84 engages the stem 201 of the deadbolt when assembled thereby putting the turn knob 10 in direct mechanical communication the deadbolt 200. When the turn knob 10 is rotated, the deadbolt throwbolt 310 will extend through the door brace 25.

In one embodiment of the present invention is attached to an existing deadbolt lock in substantially the following manner. The rear, non-keyed facing portion of a standard deadbolt lock is removed while the deadbolt lock is in a door. The deadbolt lock is then removed from the door as is the standard deadbolt door brace. The inventive door brace 25 is then replaced instead of the old one and the standard deadbolt 200 locking gear is replaced. At that point the lock body 1 is attached utilizing the screws 110 through orifices 42, 44, 32, and 34 so the standard deadbolt lock is now backed with the lock body 1 and mechanically attached. The stem 201 of the deadbolt is aligned properly so it will insert into stem 84. Stem 201 will pass through orifices 30 and 40. It is also necessary for orifices 36 and 46 to properly align so the push pin 15 will be able to side through them in operation. The push pin 15 is designed to attach in the turn knob 10 in a manner known in the industry to allow for movement of the push pin 15, but not have the push pin 15 fall out of the turn knob 10 while in use. Push pin 15 is preferably designed to be in mechanical frictional communication with orifice 82 of turn knob 10 such that push pin 15 will not fall out of the turn knob 10 while in use.

Figure 2A:
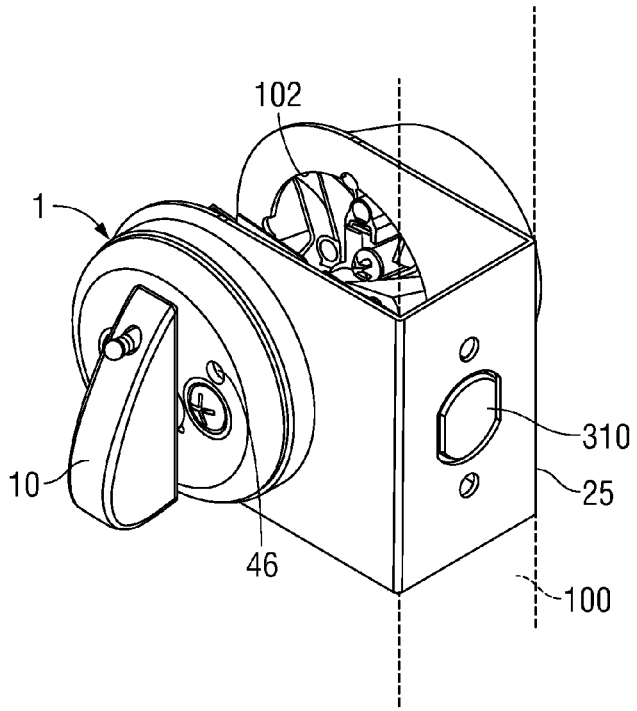
FIG. 2A illustrates one embodiment of the present invention in assembled form in unlocked position.
Figure 2B:
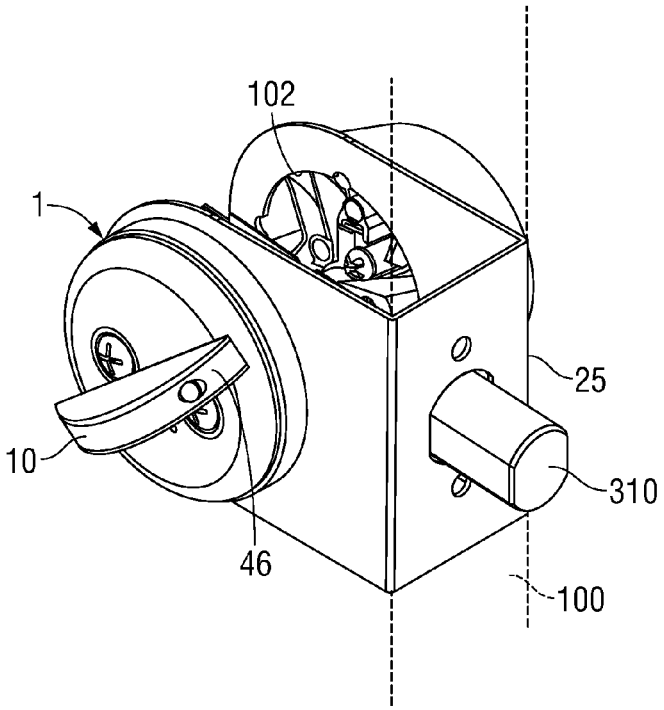
FIG. 2B illustrates an embodiment of the present invention in operation in a locked position.

As shown in FIGS. 2A and 2B, in one embodiment of the present invention, the present invention operates in substantially the following manner. When the lock body 1 is attached to an existing deadbolt mechanism the stem 84 extends through orifice 30 and orifice 40 wherein it engages the stem 201 of all standard deadbolt mechanisms. Upon engagement of the stem 201, when the turn knob 10 is turned then the mechanisms of the standard deadbolt are engaged and the deadbolt throwbolt 310 is retracted or extended through the orifice 55 on the door brace 25. When the deadbolt throwbolt 310 is extended, in one embodiment of the present invention, it is preferable that the orifice 82 of the turn knob 10 will substantially align with the orifice 46 and orifice 36 of the present invention. When this alignment occurs the user can push the push pin 15 into the orifice 46 and 36 and into the internal mechanism of the standard deadbolt mechanism thereby preventing the retraction of the deadbolt throwbolt 310 into the standard deadbolt mechanism. The retraction is prevented because the pin 15 acts as a physical barrier preventing the key, bump key, or skeleton key from being rotated in the deadbolt 200 and therein preventing the rotation of the stem 201 and the movement of the extended deadbolt throwbolt 310 through the door brace 25. When the push pin 15 is pushed into the standard deadbolt mechanism then the deadbolt is prevented from being retracted regardless if the key is inserted into the standard deadbolt lock and rotated or a skeleton or bump key is place in to the standard deadbolt lock and rotated.

As shown in FIGS. 2A and 2B, in one embodiment of the present invention operates in substantially the following manner. In order to render the standard deadbolt lock active again so that a key, bump key or skeleton key can rotate the internal mechanism and cause the deadbolt throwbolt 310 to retract, the user need to pull the push pin 15 out of the orifices 46 and 36 and out of the internal mechanism of the standard deadbolt mechanism thereby preventing the retraction of the deadbolt throwbolt 310 into the standard deadbolt mechanism. When the push pin 15 is pulled out the standard deadbolt mechanism then the deadbolt throwbolt 310 can be retracted.

Figure 3A:
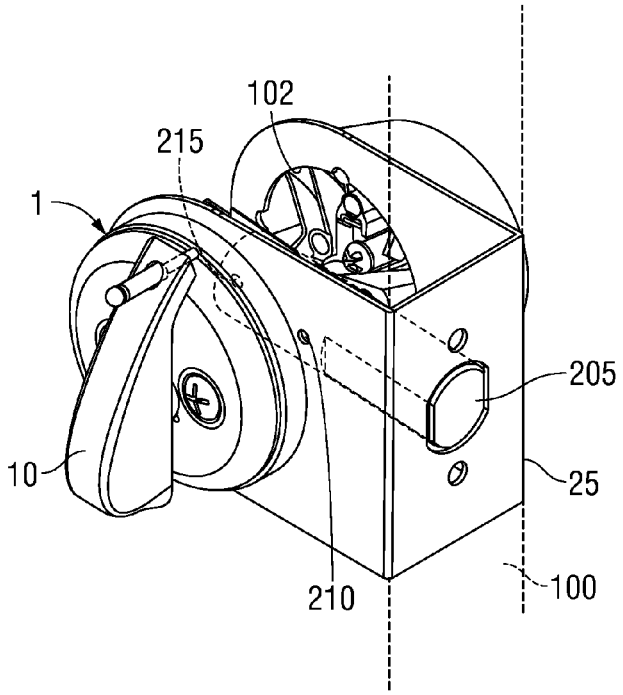
FIG. 3A illustrates one embodiment of the present invention in assembled form in unlocked position with the turn knob extending past the base plate.
Figure 3B:
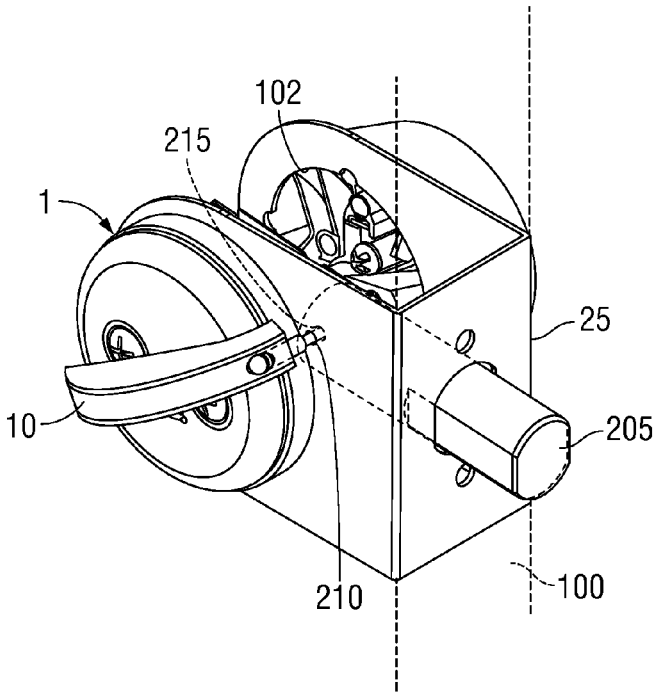
FIG. 3B illustrates an embodiment of the present invention in operation in a locked position with the turn knob extending past the base plate.

In one embodiment of the present invention as shown in FIGS. 3A and 3B, the turn knob 10 is elongated past the radius of the base plate 7. In such an embodiment the door brace 25 may have additional orifices in it which the push pin 15 can engage. It is envisioned that in one such embodiment the door brace 25 has an orifice 210 in it that will line up with a modified throw bolt 205 that has an orifice 215 in it. Whereby, when the turn knob 10 is lined up with the door brace 25 at orifice 210, the push pin 15 can be extended through the orifice 210 and 215 therein preventing the deadbolt throwbolt 310 from being retracted. In this embodiment of the present invention, there may be an additional orifice drilled through door 100 as necessary. In this embodiment of the present invention, orifices 36 and 46 are optional and need not be present In several embodiments of the present invention it is envisioned that push pin 15 can have direct mechanical communication with brace 25 at orifice 210, such that the push pm 15 can engage the orifice 210 absent any interaction or movement of turn knob 10, thereby preventing retraction of the throw bolt 205 when this throw bolt 205 is extended. In several embodiments of the invention the door brace 25 can be molded to have sides that extend up from orifice 210 allowing for placement of push pin 15 and also allowing for independent actuation of push pin 15 into orifice 210 absent any rotation of the turn bolt 10.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

What is claimed is the following:

1. An apparatus for reinforcing a deadbolt lock comprising:

a pin;

a base plate;

a cover plate;

a door;

a throw bolt;

a door brace with an orifice for engaging the throw bolt, wherein the throw bolt can extend through the door brace;

said door brace further comprising three faces designed to around a standard edge of the door containing a portion of the deadbolt lock that is the face of said throw bolt;

a base plate further comprising an orifice for engaging said pin;

said base plate further being mechanically attached to the door brace;

said cover plate further comprising an orifice for engaging said pin;

said cover plate further comprising being statically mechanically attached to the said base plate;

a turn knob attached to said cover plate;

said turn knob further comprising being in rotational communication with the throw bolt; and said turn knob further comprising an orifice for said pin wherein in said pin is frictionally engaged with said turn knob further comprising an orifice and said pin has no external attachments to said base plate or said face plate;

said turn knob further comprising being in mechanical communication with said pin to form a single pinning apparatus wherein said pin is not removable from said orifice of said turn knob;

wherein the turn knob can be rotated allowing the pin to engage the door brace and prevent movement of the throw bolt through the door brace.

2. The apparatus of claim 1 for reinforcing a deadbolt lock further comprising;

said door brace has a second orifice on the same face as the base plate is attached;

said throw bolt has an orifice bore through it; wherein the turn knob can be rotated allowing the pin to engage the door brace second orifice and then further engage said throw bolt with and orifice bore, thereby preventing movement of the throw bolt through the door brace.

3. The apparatus of claim 1 for reinforcing a deadbolt lock further comprising;

the pin for the door brace is disengageable, thereby allowing movement of the throw bolt through the door brace.

4. An apparatus for reinforcing a deadbolt lock comprising:

a pin;

a base plate;

a cover plate wherein said pin is not attached to said cover plate;

a throw bolt;

a door brace with a door brace orifice for receiving said throw bolt, wherein said throw bolt can be moved through said door brace orifice to extend beyond said door brace;

said door brace further comprising three faces designed to fit around a standard edge of a door, where one of said three faces is in direct surface contact with said standard edge of said door;

said base plate further comprising a base plate orifice for engaging said pin wherein said pin is not attached to said base plate;

said base plate further being mechanically attached to the door brace; and a turn knob attached to said cover plate and in rotational communication with said throw bolt, wherein said turn knob further comprises a turn knob orifice for said pin, said turn knob further comprising being in mechanical communication with said pin to form a single pinning apparatus wherein said pin is not removable; wherein in said pin is frictionally engaged with said turn knob further comprising an orifice and said pin has no external attachments to said base plate or said face plate; and further wherein said turn knob is rotatable to enable said turn knob orifice to be substantially aligned with said base plate orifice for engaging said pin in such a way that when said turn knob is rotated to achieve said alignment, said pin restricts said throw bolt from being moved through said door brace, wherein each of said door brace, said base plate and said pin, when combined, reinforce restriction of movement of said throw bolt.

5. The apparatus of claim 4, wherein said cover plate is mechanically attached to the base plate, said cover plate further comprises a cover plate orifice for engaging said pin and said cover plate contributes further reinforcement in combination with said door brace, said base plate and said pin against movement of said throw bolt.

6. The apparatus of claim 4, wherein said base plate and said cover plate are formed as a single piece, wherein said single piece comprises a face and a base and incorporates said base plate orifice in such a way that it accessible through an orifice in said cover plate, wherein said cover plate is said face of said single piece and said base plate forms said base of said single piece.

7. The apparatus of claim 5, wherein said throw bolt contains a throw bolt orifice for accepting insertion of said pin so that when said insertion of said pin into said throw bolt orifice occurs, said insertion restricts movement of said throw bolt through said door brace.

8. The apparatus of claim 7, wherein said throw bolt, when said pin is inserted into said throw bolt orifice, contributes further reinforcement in combination with said door brace, said base plate, said cover plate and said pin to restrict movement of said throw bolt.

9. The apparatus of claim 8 wherein restriction of said movement of said throw bolt is removed by disengagement of said pin from said throw bolt orifice.

10. The apparatus of claim 8, wherein said movement of said throw bolt that is restricted is a lateral movement of retraction into said door through said door brace.

11. An apparatus for reinforcing a deadbolt lock comprising:

a pin;

a base plate;

a cover plate;

a door;

a throw bolt;

a door brace with an orifice for engaging the throw bolt, wherein the throw bolt can extend through the door brace;

said door brace further comprising three faces designed to around a standard edge of the door containing a portion of the deadbolt lock that is the face of said throw bolt;

a base plate further comprising an orifice for engaging said pin wherein said pin is not attached to said base plate;

said base plate further being mechanically attached to the door brace;

said cover plate further comprising an orifice for engaging said pin wherein said pin is not attached to said cover plate;

said cover plate further comprising being statically mechanically attached to the said base plate;

a turn knob attached to said cover plate;

said turn knob further comprising being in rotational communication with the throw bolt; and said turn knob further comprising an orifice for said pin wherein in said pin is frictionally engaged with said turn knob further comprising an orifice;

said turn knob further comprising being in mechanical communication with said pin to form a single pinning apparatus wherein said pin is not removable from said orifice of said turn knob;

wherein the turn knob can be rotated allowing the pin to engage the door brace and prevent movement of the throw bolt through the door brace.

* * * * *